US007210170B2

(12) United States Patent
Lee

(10) Patent No.: US 7,210,170 B2
(45) Date of Patent: May 1, 2007

(54) DISPOSABLE SWIMSUIT

(76) Inventor: Judy Lee, 786 S. Lincoln Ave., Monterey Park, CA (US) 91755

( * ) Notice: Subject to any disclaimer, the term of this patent is extended or adjusted under 35 U.S.C. 154(b) by 0 days.

(21) Appl. No.: 10/968,221

(22) Filed: Oct. 18, 2004

(65) Prior Publication Data

US 2006/0080753 A1 Apr. 20, 2006

(51) Int. Cl.
*A41D 5/00* (2006.01)

(52) U.S. Cl. ..... 2/67; 2/450; 2/58; D2/706; D2/731

(58) Field of Classification Search ..... 2/67; D2/706, 731
See application file for complete search history.

(56) References Cited

U.S. PATENT DOCUMENTS 3,847,158 A * 11/1974 Guidoni ..... 450/68
3,881,489 A * 5/1975 Hartwell ..... 604/369
3,939,845 A * 2/1976 Guidoni ..... 450/68
4,031,900 A * 6/1977 Guidoni ..... 450/69
4,414,691 A * 11/1983 Estruch ..... 2/67
5,518,799 A * 5/1996 Finestone et al. ..... 428/137
5,631,074 A * 5/1997 Herlihy, Jr. ..... 442/35
6,195,800 B1 * 3/2001 Gilmer et al. ..... 2/67
6,582,412 B2 * 6/2003 Christoffel et al. .... 604/385.01
2003/0088902 A1 * 5/2003 Levy ..... 2/50

OTHER PUBLICATIONS

Vogue, Jun. 2003, p. 272. Bikini by Laura Urbinati.*

* cited by examiner

*Primary Examiner*—Gary L. Welch
*Assistant Examiner*—Richale L. Haney
(74) *Attorney, Agent, or Firm*—Raymond Y. Chan; David and Raymond Patent Group

(57) ABSTRACT

A disposable swimsuit includes a lower piece having a front covering piece and a back covering piece to define two leg openings at two outer edges of the lower piece and a waist opening at two upper edges of the front and back covering pieces. The disposable swimsuit is made of swimwear garment including an outer stretchable layer and a lining layer overlappedly attached to the outer stretchable layer in an edge to edge manner, wherein the outer stretchable layer is made of water resistant material having air ventilating ability and flexibility, wherein the lining layer is made of non-irritant and air ventilating material.

8 Claims, 5 Drawing Sheets

DISPOSABLE SWIMSUIT

BACKGROUND OF THE INVENTION

1. Field of Invention

The present invention relates to a swimsuit, and more particularly to a disposable swimsuit which can be adjusted to fit the body size of the wearer and is well suited for disposable one-time use for hygiene purpose while being cost effective.

2. Description of Related Arts

Various kinds of swimsuits, such as one-piece swimsuits or bikini swimsuits, are provided in the market not only for outdoor sports, such as swimming, but also for sun bathing, pool party, or enjoying spa. Therefore, it is desirable to have different types of swimsuits for a specific purpose and occasion.

In addition, the user needs a swimsuit for the occasion such as enjoying the spa at friend's house or going to swim in the fitness center after work. Therefore, the user may merely either wear no clothing or purchase another new swimsuit for such occasion. It is worth to mention that the user should wear his or her own swimsuit not only for hygiene purpose but also for fitting his or her body. Even though the swimsuit is washed every time after use, especially for common swimming or bathing area, the swimsuit is not absolutely clean that any germs may still exist on the swimsuit.

Furthermore, swimsuits are made of expandable or elastic material so that the user is able to fittingly wear the swimsuit. If the user wears an unsuited swimsuit, especially for the bikini that the bikini cups should be retained in position to cover the wearer's breasts, the swimsuit may be taken off accidentally during swimming. It is worth to mention that a suitable swimsuit can provide support and shaping to the body of the user for enhancing the aesthetically pleasing appearance.

SUMMARY OF THE INVENTION

A main object of the present invention is to provide a disposable swimsuit, which is made of material well suited for disposable one-time use for hygiene purpose while being cost effective.

Another object of the present invention is to provide a disposable swimsuit, which comprises an outer stretchable layer and a lining layer overlapped with the outer stretchable layer. The outer stretchable layer of the disposable swimsuit is made of flexible and water resistant material such as poly propylene to tightly fit the body of wearer when worn so as to allow the body movement of the wearer. The lining layer is made of non-irritant and air ventilating material to comfortably contact with the body of wearer.

Another object of the present invention is to provide a disposable swimsuit, wherein the adjustable straps of the disposable swimsuit can be adjusted to fit the body size of the wearer such that the disposable swimsuit fits for slim women or full-figured women.

Another object of the present invention is to provide a disposable swimsuit, which can be designed or configured as a swimsuit for men or bikini swimsuit having an upper piece and lower piece for women.

Another object of the present invention is to provide a disposable swimsuit, which does not require any expensive material and complicated manufacturing process such that it is affordable for the wearer to purchase the disposable swimsuit in a convenient store or even in the gym for the occasion as a disposable one-time use swimsuit.

Accordingly, in order to accomplish the above objects, the present invention provides a disposable swimsuit which comprises a lower piece having a front covering piece and a back covering piece to define two leg openings at two outer edges of the lower piece and a waist opening at two upper edges of the front and back covering pieces.

The disposable swimsuit is made of swimwear garment comprising an outer stretchable layer and a lining layer overlappedly attached to the outer stretchable layer in an edge to edge manner, wherein the outer stretchable layer is made of water resistant material having air ventilating ability and flexibility, wherein the lining layer is made of non-irritant and air ventilating material.

These and other objectives, features, and advantages of the present invention will become apparent from the following detailed description, the accompanying drawings, and the appended claims.

DETAILED DESCRIPTION OF THE PREFERRED EMBODIMENT

Figure 1:
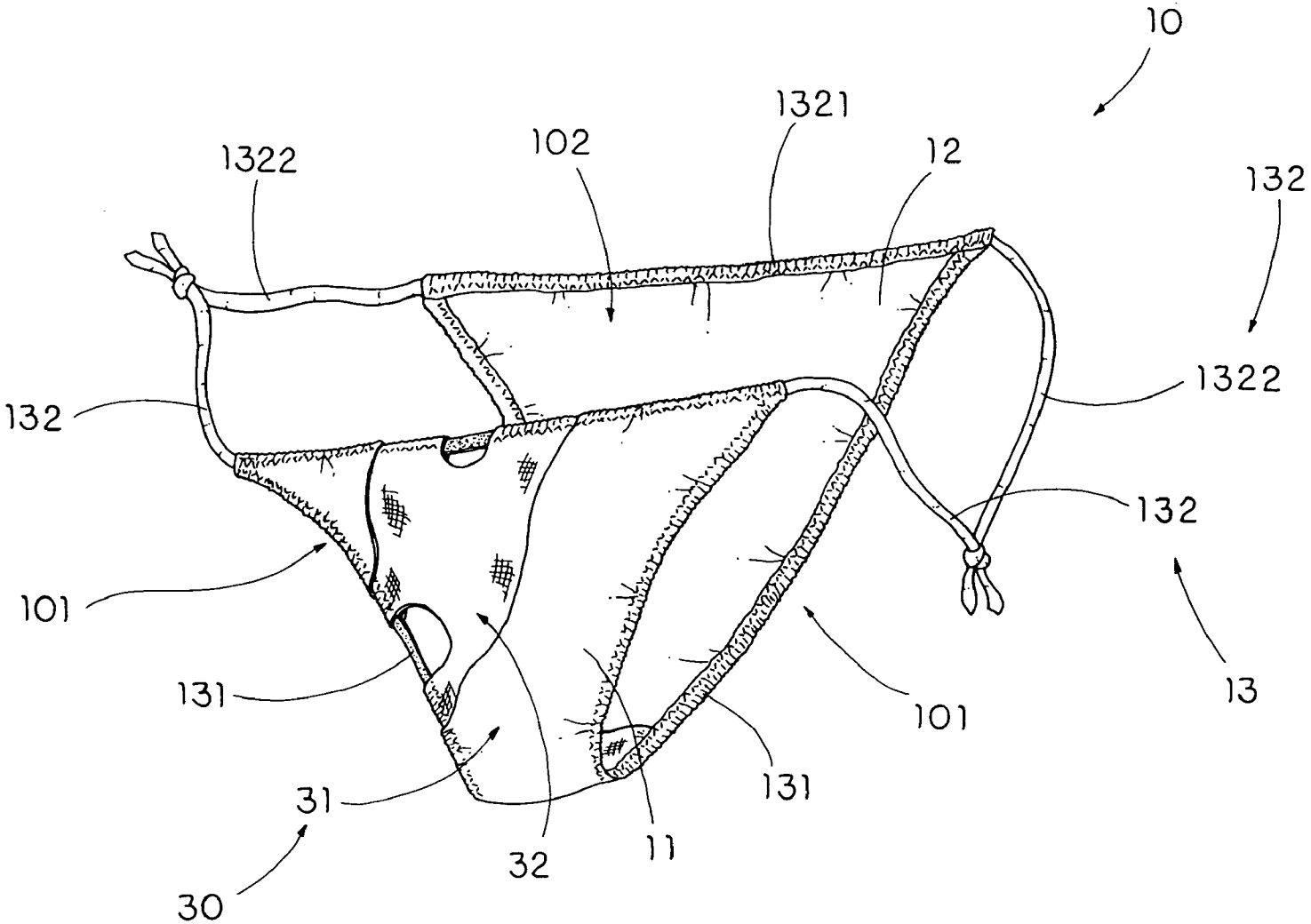
FIG. 1 is a perspective view of a lower piece of a disposable swimsuit according to a preferred embodiment of the present invention.

Referring to FIGS. 1 through 5 of the drawings, a disposable swimsuit according to a preferred embodiment of the present invention is illustrated, wherein the disposable swimsuit comprises a lower piece 10 and an upper piece 20.

The disposable swimsuit is made of swimwear garment 30 comprising an outer stretchable layer 31 and a lining layer 32 overlappedly attached to the outer stretchable layer 32 in an edge to edge manner. In other words, the upper and lower pieces 20, 10 are made of the swimwear garment 30.

The outer stretchable layer 31 is made of water resistant material having air ventilating ability and flexibility. Accordingly, the outer stretchable layer 31 can be stretched to tightly fit the body of wearer when worn so as to allow the body movement of the wearer, especially for swimming. In other words, the outer stretchable layer 31 can fit the body curvature of the wear when the wearer wears the disposable swimsuit of the present invention. Preferably, the outer stretchable layer 31 is made of poly propylene.

The lining layer 32 is made of non-irritant, soft and air ventilating material as an inner layer to comfortably contact with the body of wearer. In addition, the lining layer 32 can absorb the sweat of the wearer during exercise so as to enhance the comfortability of the disposable swimsuit. Accordingly, the lining layer 32 is made of germ-free tissue such as synthetic tissue paper that should be non-irritant and has a disinfectious ability for preventing germs and skin disease from being infected such that the disposable swimsuit is easy and economical to manufacture so as to well suit for disposable one-time use safety. Moreover, the used disposable swimsuit can be collected and recycled after further treatment.

As shown in FIG. 1, the lower piece 10, which is embodied as a trunk for men or a bikini top for women, has a front covering piece 11 and a back covering piece 12 to define two leg openings 101 at two outer edges of the lower piece 10 and a waist opening 102 at upper edges of the front and back covering pieces 11, 12.

The lower piece 10 further comprises a lower body attachment 13 provided at the lower piece 10 for fastening the lower piece 10 to a lower body of the wearer. The lower body attachment 13 comprises two elongated elastic leg straps 131 fastened along the two outer edges of the lower piece 10 at the two leg openings 101 thereof respectively and two elongated elastic waist straps 132 fastened along the upper edges of the front and back covering pieces 11, 12 respectively to form the waist opening 102.

Figure 2:
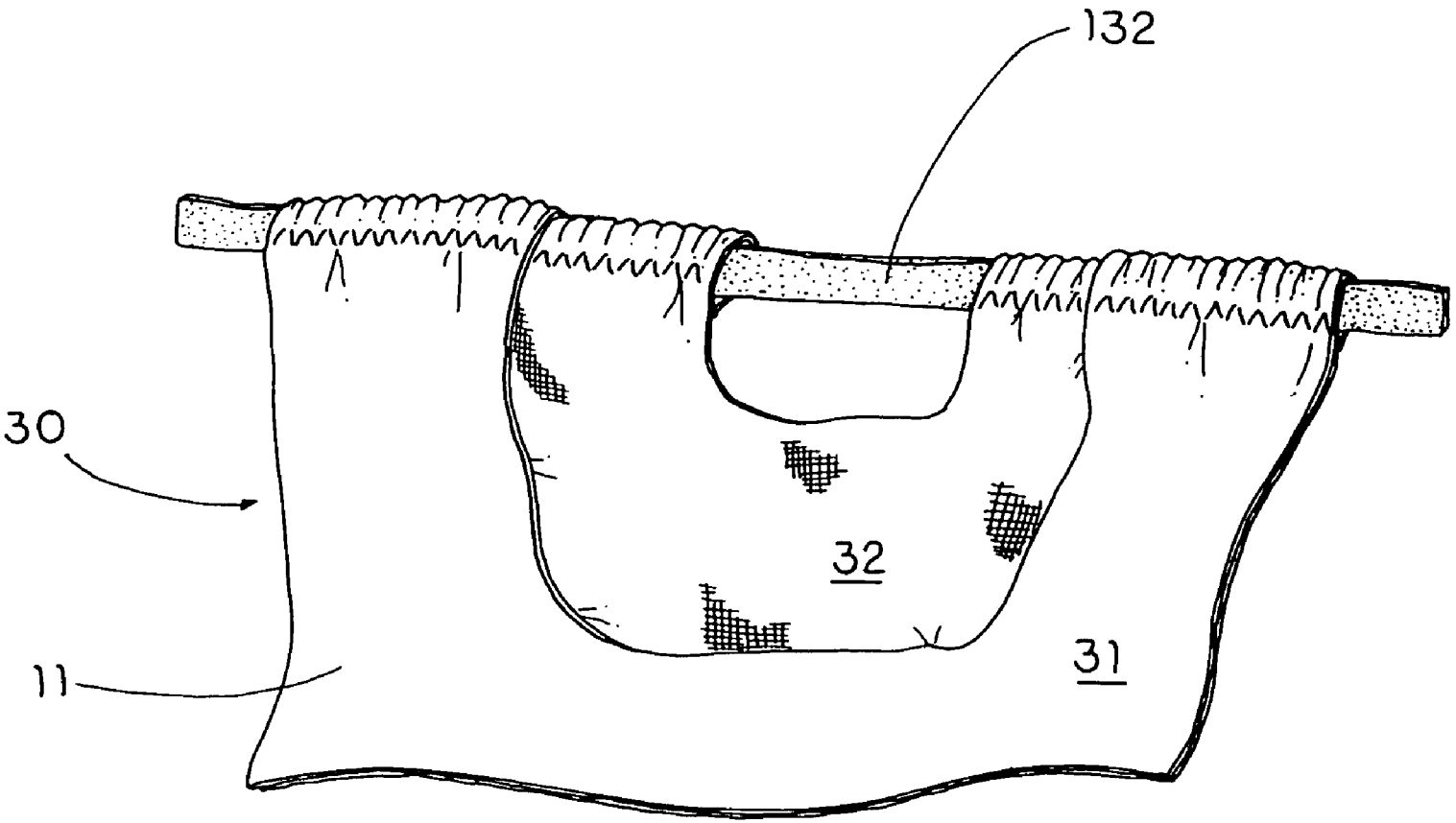
FIG. 2 illustrates the swimwear garment of the lower piece of the disposable swimsuit according to the above preferred embodiment of the present invention.

As shown in FIG. 2, a length of each of the elastic waist straps 132 is longer than that of the upper edge of the respective front and back covering pieces 11, 12, wherein each of the elastic waist straps 132 has a mid-affixing portion 1321 affixing to the upper edge of the respective front and back covering pieces 11, 12 to provide an elasticity thereof and two free end portions 1322 sidewardly extended from two sides of the respective front and back covering pieces 11, 12 such that the sizes of the waist opening 102 and the leg openings 101 are selectively adjusted when the free end portions 1322 of the elastic waist straps 132 are tightened correspondingly. In other words, the lower piece 10 can tightly fit the body of wearer that the two leg openings 101 are adjusted to fittingly encircle the legs fork of the wearer by the elastic leg straps 131 and the waist opening 102 is adjusted to fittingly encircle the waist of the wearer by the elastic waist straps 132.

Accordingly, two outer edges of the outer stretchable layer 31 are overlappedly attached with two outer edges of the lining layer 32 to form two seams as the two outer edges of the lower piece 10, as shown in FIG. 2, wherein the mid-affixing portions 1321 of the elastic waist straps 132 are sewn to be enfolded within the two seams so as to securely fasten the two elastic waist straps 132 at the upper edges of the front and back covering pieces 11, 12. It is worth to mention that the two elastic leg straps 131 are also sewn to be enfolded within the two outer edges of the lower piece 10 at the two leg openings 101 thereof as shown in FIG. 2.

Figure 3:
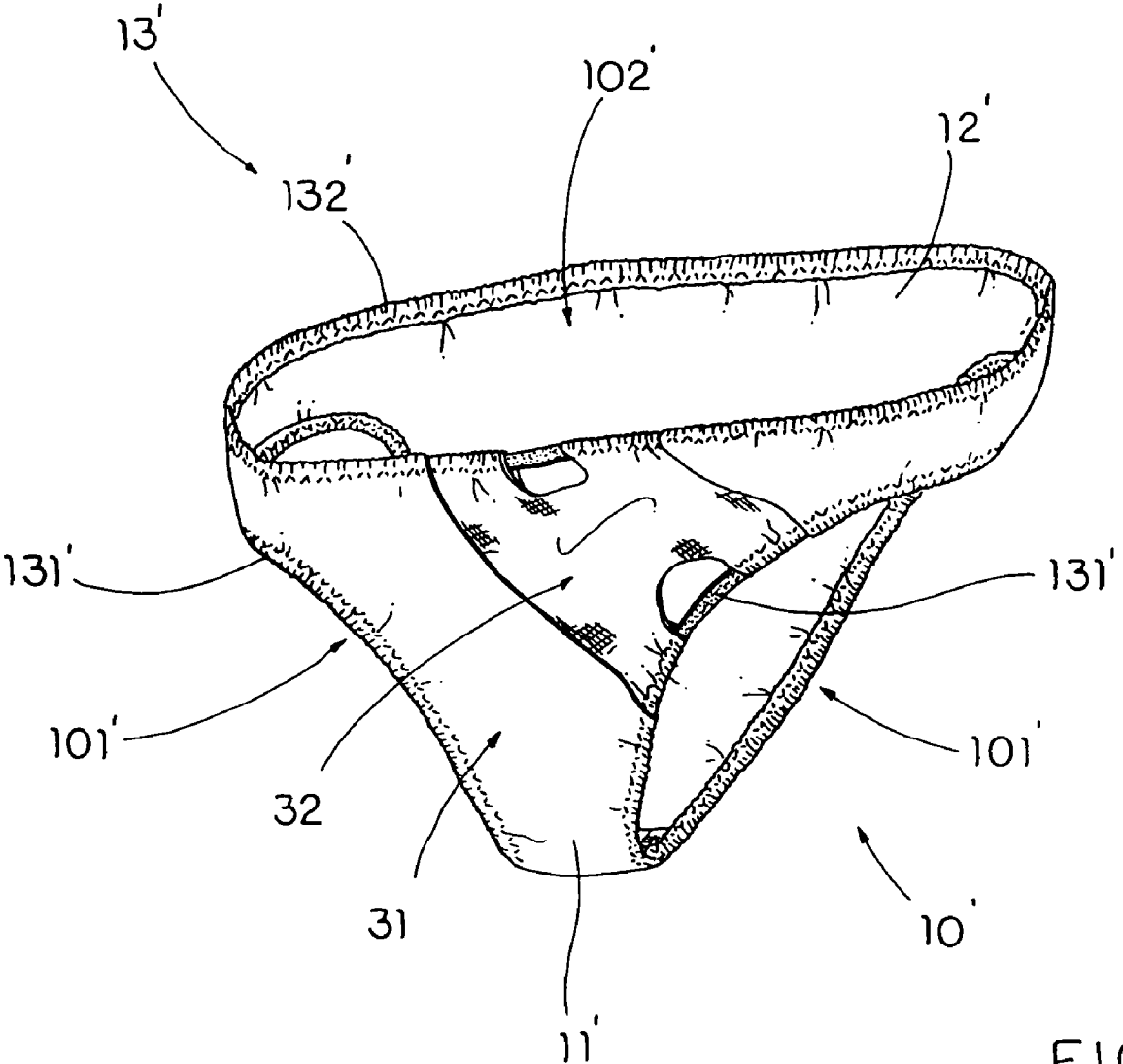
FIG. 3 illustrates an alternative mode of the lower piece of the disposable swimsuit according to the above preferred embodiment of the present invention.

FIG. 3 illustrates an alternative mode of the lower piece 10' which is made of swimwear garment 30 including the outer stretchable layer 31 and the lining layer 32, having a front covering piece 11' and a back covering piece 12' to define two leg openings 101' at two outer edges of the lower piece 10' and a waist opening 102' at upper edges of the front and back covering pieces 11', 12'. The lower body attachment 13' comprises two elastic leg loops 131' attaching to the leg openings 101' respectively and an elastic waist loop 132' attaching to the waist opening 102'.

Figure 4:
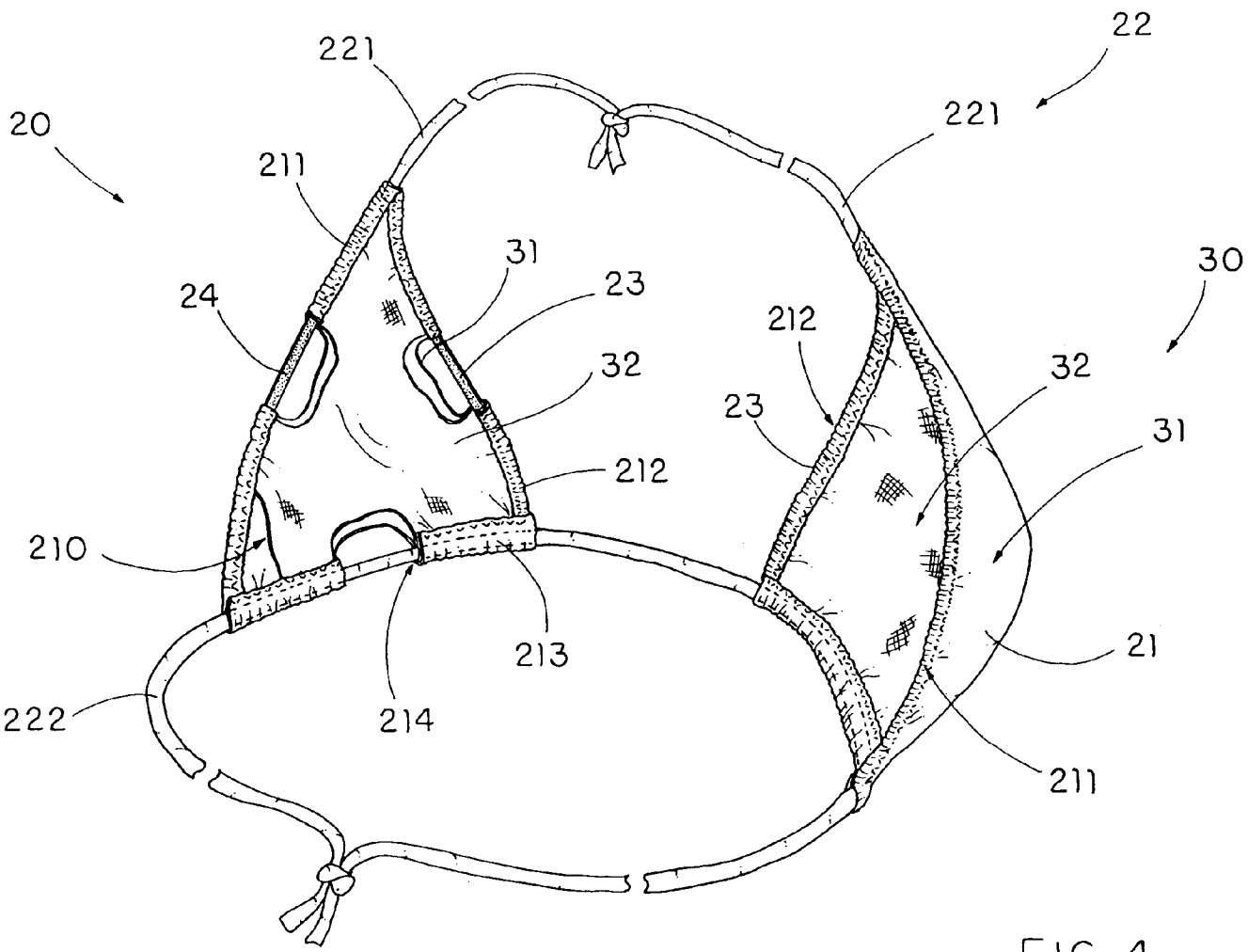
FIG. 4 is a perspective view of an upper piece of the disposable swimsuit according to the above preferred embodiment of the present invention.

As shown in FIG. 4, the upper piece 20, which is embodied as a bikini top, comprises two breast cups 21 which are made of the swimwear garment 30, and an upper body attachment 22 provided at the upper piece 20 for retaining the breast cups 21 in position to cover the wearer's breasts respectively.

Each of the breast cups 21 has an outer elastic cup edge 211, an inner elastic cup edge 212, and a bottom cup edge 213 to form a cup area having a size covering at least a portion of the wearer's breast. As shown in FIG. 4, two elastic bands 23 are seamed to be enfolded within the two inner elastic cup edges 212 of the breast cups 21 for providing elasticity. In addition, two elastic strips 24 are seamed to be enfolded within the outer elastic cup edges 212 of the breast cups 21 respectively for providing elasticity.

Figure 5:
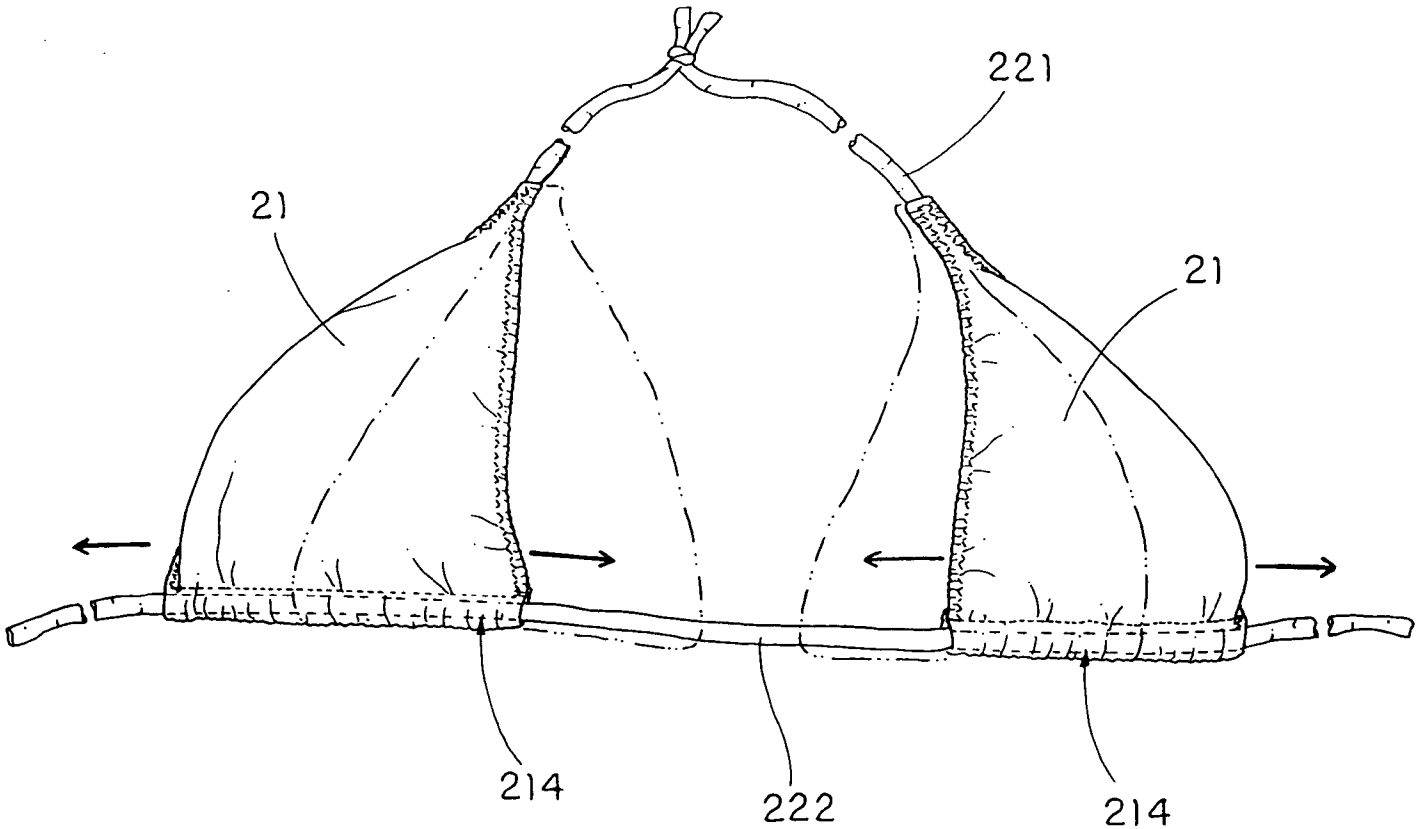
FIG. 5 illustrates the sliding adjustment of breast cups of the upper piece of the disposable swimsuit according to the above preferred embodiment of the present invention.

The upper body attachment 22 comprises two elongated elastic neck straps 221 upwardly extended from the two breast cups 21 respectively for fastening around the wearer's neck, and an elongated elastic chest strap 222 slidably extended along the two bottom cup edges 213 of the breast cups 21 for fastening around the wearer's chest, wherein the breast cups 21 are adjustably slid along the elastic chest strap 222 to adjust a distance between the breast cups 21 corresponding to a distance between the wearer's breasts, as shown in FIG. 5, for fittingly retaining the breast cups 21 in position to cover the wearer's breasts respectively. Accordingly, the elastic neck straps 221 are adjustably tightened to form a neck loop for encircling with the wearer's neck.

The bottom edge 213 of each of the breast cups 21 is folded to form a sliding groove 214 therealong wherein the elastic chest strap 222 is slidably passing through the two sliding grooves 214 such that the two breast cups 21 are allowed to slide along the elastic chest strap 222 to selectively adjust the distance between the breast cups 21. Accordingly, the wearer is able to tighten two end portions of the elastic chest strap 22 around the wearer's chest to support the upper piece 20 thereon and to slide the breast cups 21 to adjust the distance therebetween until the breast cups 21 fittingly cover the wearer's breasts respectively. As shown in FIG. 4, each of the elastic chest straps 222 has an elastic portion enfolded along the bottom edge 213 of the respective breast cup 21 along the sliding groove 214 thereof for providing elasticity so as to substantially retain the breast cup 21 in position.

According to the preferred embodiment, each of the breast cups 21 further has a side opening 210 formed between the outer stretchable layer 31 and the inner lining 32. Therefore, the wearer is able to put a cushion pad in each breast cup 21 between the outer stretchable layer 31 and the inner lining 32 through the respective side opening 210 for additional support and further enhancing the aesthetically pleasing appearance.

It is worth to mention that the material of the swimwear garment 30 is inexpensive and is adapted to be cycled while the manufacturing process of the disposable swimsuit of the present invention is simple and in low cost, the disposable swimsuit is well suited for disposable one-time use for hygiene purpose while being cost effective. Therefore, an individual is affordable to purchase the disposable swimsuit at any convenient store. The disposable swimsuit can be free to use in the fitness center for the member thereof to enjoy swimming or spa. Thus, the size of the disposable swimsuit is adjustable to fit the body size of the wearer by the upper and lower body attachments 21, 13 for enhancing the aesthetically pleasing appearance, such that the disposable swimsuit fits for slim men or full-figured women.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A disposable swimsuit for a wearer, comprising:

an upper piece comprising two breast cups;

a lower piece having a front covering piece and a back covering piece to define two leg openings at two elastic outer edges of said lower piece and a waist opening at two elastic upper edges of said front and back covering pieces, wherein each of said upper and lower pieces comprises an outer stretchable layer and a lining layer overlappedly attached to said outer stretchable layer, wherein said outer stretchable layer is made of water resistant polypropylene material or the like having air ventilating ability and flexibility, wherein said lining layer is made of non-irritant and air ventilating tissue paper;

an upper body attachment provided at said upper piece for retaining said breast cups in position to cover said wearer's breasts respectively, wherein said upper body attachment comprises two elongated elastic neck straps upwardly extended from said two breast cups respectively for fastening around said wearer's neck, and an elongated elastic chest strap slidably extended along two bottom cup edges of said breast cups for fastening around said wearer's chest, wherein said breast cups are adjustably slid along said elastic chest strap to adjust a distance between said breast cups corresponding to a distance between said wearer's breasts for fittingly retaining said breast cups in position to cover said wearer's breasts respectively; and a lower body attachment provided at said lower piece for detachably fastening said lower piece on a lower body of said wearer.

2. The disposable swimsuit, as recited in claim 1, wherein said bottom edge of each of said breast cups is folded to form a sliding groove therealong, wherein said elastic chest strap is slidably passing through said two sliding grooves such that said two breast cups are allowed to slide along said elastic chest strap to selectively adjust said distance between said breast cups.

3. The disposable swimsuit, as recited in claim 2, wherein said lower body attachment comprises two elongated elastic leg straps fastened along said two outer edges of said lower piece at said two leg openings thereof respectively and two elongated elastic waist straps fastened along said upper edges of said front and back covering pieces respectively to form said waist opening.

4. The disposable swimsuit, as recited in claim 3, wherein a length of each of said elastic waist straps is longer than that of said upper edge of said respective front and back covering pieces, wherein each of said elastic waist straps has a mid-affixing portion affixing to said upper edge of said respective front and back covering pieces to provide an elasticity thereof and two free end portions sidewardly extended from two sides of said respective front and back covering pieces such that sizes of said waist opening and said leg openings are selectively adjusted when said free end portions of said elastic waist straps are tightened correspondingly.

5. The disposable swimsuit, as recited in claim 4, wherein said mid-affixing portions of said elastic waist straps are sewn to be enfolded within said two upper edges of said front and back covering pieces respectively so as to securely fasten said two elastic waist straps at said upper edges of said front and back covering pieces.

6. The disposable swimsuit, as recited in claim 1, wherein said lower body attachment comprises two elongated elastic leg straps fastened along said two outer edges of said lower piece at said two leg openings thereof respectively and two elongated elastic waist straps fastened along said upper edges of said front and back covering pieces respectively to form said waist opening.

7. The disposable swimsuit, as recited in claim 6, wherein a length of each of said elastic waist straps is longer than that of said upper edge of said respective front and back covering pieces, wherein each of said elastic waist straps has a mid-affixing portion affixing to said upper edge of said respective front and back covering pieces to provide an elasticity thereof and two free end portions sidewardly extended from two sides of said respective front and back covering pieces such that sizes of said waist opening and said leg openings are selectively adjusted when said free end portions of said elastic waist straps are tightened correspondingly.

8. The disposable swimsuit, as recited in claim 7, wherein said mid-affixing portions of said elastic waist straps are sewn to be enfolded within said two upper edges of said front and back covering pieces respectively so as to securely fasten said two elastic waist straps at said upper edges of said front and back covering pieces.

* * * * *